US006936092B2

(12) United States Patent
Seyffert et al.

(10) Patent No.: US 6,936,092 B2
(45) Date of Patent: Aug. 30, 2005

(54) POSITIVE PRESSURE DRILLED CUTTINGS MOVEMENT SYSTEMS AND METHODS

(75) Inventors: Kenneth W. Seyffert, Houston, TX (US); William Christian Herben, Magnolia, TX (US); James Michael McIntosh, The Woodlands, TX (US)

(73) Assignee: Varco I/P, Inc., Houston, TX (US)

( * ) Notice: Subject to any disclaimer, the term of this patent is extended or adjusted under 35 U.S.C. 154(b) by 92 days.

(21) Appl. No.: 10/392,285

(22) Filed: Mar. 19, 2003

(65) Prior Publication Data

US 2004/0182605 A1 Sep. 23, 2004

(51) Int. Cl.[7] ..... B01D 45/12

(52) U.S. Cl. ..... 95/271; 55/315; 55/319; 55/459.1; 55/466; 55/467; 175/66

(58) Field of Search ..... 95/271; 55/315, 55/319, 459.1, 466, 467; 175/66

(56) References Cited

U.S. PATENT DOCUMENTS

| | | | |
|---|---|---|---|
| 1,559,666 | A | 11/1925 | Bernier |
| 2,576,283 | A | 11/1951 | Chaney |
| 2,816,803 | A | 12/1957 | Clark et al. |

(Continued)

FOREIGN PATENT DOCUMENTS

| | | |
|---|---|---|
| EP | 0060137 | 9/1982 |
| EP | 0 668 968 B1 | 5/1997 |
| EP | 0 630 839 B1 | 9/1997 |

(Continued)

OTHER PUBLICATIONS

Int'l Preliminary Examination Report. PCT/GB2004/000762. Aug. 12, 2004. 25 pages.

Verti–G Cuttings Dryer: Proactive environmental protection—productive fluids recovery, Safeguard SWACO, a Smith/Schlumberger Col., 3pp. 2000.

Verti–G Cuttings Dryer/Dual Hopper Boosts Recovery, Safeguard SWACO, a Smith/Schlumberger Co., 2pp. 2000.

Catapult Conveying Systems, Hadco Recovery Systems, 4 pp. 2002.

F D–25 Cuttings Box, Brandt, 1999.

Russian Far East, SWACO, 1 p. 2002.

Vortex Dryer, Brandt, 2001.

Environmentally Sound, Cost–Effective Oilfield Waste Disposal, Sweco Oilfield Services, 4 pp. 1999.

Our Experience For Our Customers, Nol–Tec Europe, SRL, 49 pp. 2001.

"Operating and Maintenance Instructions for Don Valley Horizontal Mud Recovery Centrifuge MUD 10;" Don Valley Engineering Company Limited, 1996.

Form PCT/ISA/206: PCT/GB2004/00762 & Annex: mailed Mar. 6, 2994: 5 pp.

Form PCT/ISA/210 [8 pp.] and Form PCT/ISA/237 [7 pp. ]: PCT/GB2004/00762: mailed Jul. 21, 2004.

Experimental Observations Obtained From Long Distance Pneumatic COnveying Studies. R.D. Marcus Pneumatech 2. Int'l Conference on Pneumatic Conveying Technology: pp. 126–149. Book Cover. & Copyright notice page: 1984.

Pneumatic Conveying Of Solids, Klinzing & Marcus, pp. 1–6, 284–288. 290–298, 426–428. and 480; 1997.

*Primary Examiner*—Robert A. Hopkins
(74) *Attorney, Agent, or Firm*—Guy McClung

(57) ABSTRACT

Methods for moving drilled cuttings, the methods, in certain aspects, including conveying with air under positive pressure, drilled cuttings to flow conduit apparatus; applying air under positive pressure to the flow conduit apparatus to continuously move the drilled cuttings material therethrough; continuously moving the drilled cuttings material with the air under pressure to separation apparatus; with the separation apparatus continuously separating drilled cuttings from air; wherein, in certain aspects, the drilled cuttings are included in a low density slurry with drilling fluid, drilling mud, and/or oil and wherein, in certain aspects, the separation apparatus is a cyclone separator and the drilled cuttings moved into the cyclone separator are wet; and systems for effecting such methods.

22 Claims, 7 Drawing Sheets

U.S. PATENT DOCUMENTS

| | | | | |
|---|---|---|---|---|
| 2,979,235 | A | 4/1961 | Greaves | |
| 3,071,297 | A | 1/1963 | Lee | |
| 3,221,825 | A | 12/1965 | Henderson | |
| 3,420,419 | A | 1/1969 | Haslett, Jr. | |
| 3,708,207 | A | 1/1973 | Steele | 302/24 |
| 3,762,773 | A | 10/1973 | Schroeder | 302/53 |
| 3,927,757 | A | 12/1975 | Fauth | 198/37 |
| 4,059,195 | A | 11/1977 | MacDonald et al. | 214/44 R |
| 4,073,244 | A | 2/1978 | Snowdon | 110/165 R |
| 4,085,975 | A | 4/1978 | Bilkvist | 302/23 |
| 4,098,412 | A | 7/1978 | Shakshober | 214/15 D |
| 4,137,935 | A | 2/1979 | Snowdon | 137/242 |
| 4,165,133 | A | 8/1979 | Johnson | 406/109 |
| 4,181,494 | A | 1/1980 | Kimberley | 432/2 |
| 4,200,412 | A | 4/1980 | Steele | 406/22 |
| 4,355,929 | A | 10/1982 | Snowdon | 406/125 |
| 4,430,030 | A | 2/1984 | Langen et al. | 406/146 |
| 4,515,503 | A | 5/1985 | Snowdon | 406/11 |
| 4,525,106 | A | 6/1985 | DiBuo et al. | 406/60 |
| 4,525,107 | A | 6/1985 | Feldsted | 406/25 |
| 4,546,783 | A | 10/1985 | Lott | 134/109 |
| 4,595,422 | A | 6/1986 | Hill et al. | 134/19 |
| 4,606,283 | A | 8/1986 | Des Ormeaux et al. | 110/250 |
| 4,662,799 | A | 5/1987 | Paul et al. | 406/14 |
| 4,726,301 | A | 2/1988 | Des Ormeaux et al. | 110/250 |
| 4,822,542 | A | 4/1989 | Kuwabara et al. | 264/50 |
| 4,834,587 | A | 5/1989 | Crawley et al. | 406/23 |
| 4,861,200 | A | 8/1989 | Lubbehusen et al. | 406/14 |
| 4,881,473 | A | 11/1989 | Skinner | 110/244 |
| 4,941,779 | A | 7/1990 | Dewitz et al. | 406/138 |
| 5,071,290 | A | 12/1991 | Johnson | 406/171 |
| 5,090,498 | A | 2/1992 | Hamill | 175/206 |
| 5,122,038 | A | 6/1992 | Malkoski | 417/313 |
| 5,129,468 | A | 7/1992 | Parmenter | 175/66 |
| 5,248,222 | A | 9/1993 | Littman et al. | 406/142 |
| 5,303,786 | A | 4/1994 | Prestridge et al. | 175/66 |
| 5,303,998 | A | 4/1994 | Whitlatch et al. | 366/3 |
| 5,310,285 | A | 5/1994 | Northcott | 588/250 |
| 5,402,857 | A | 4/1995 | Dietzen | 175/66 |
| 5,433,559 | A | 7/1995 | VandeSande | 406/145 |
| 5,439,489 | A | 8/1995 | Scalliet et al. | 44/281 |
| 5,454,957 | A | 10/1995 | Roff | 210/768 |
| 5,570,749 | A | 11/1996 | Reed | 175/66 |
| 5,624,058 | A | 4/1997 | Bailey | 222/240 |
| 5,842,529 | A | 12/1998 | Dietzen | 175/66 |
| 5,853,583 | A | 12/1998 | Shah | 210/340 |
| 5,884,715 | A | 3/1999 | Reddoch | 176/66 |
| 5,913,372 | A | 6/1999 | Dietzen | 175/66 |
| 5,996,484 | A | 12/1999 | Reddoch | 100/37 |
| 6,055,781 | A | 5/2000 | Johanson | 52/197 |
| 6,106,733 | A | 8/2000 | Wood | 210/774 |
| 6,138,834 | A | 10/2000 | Southale | 209/17 |
| 6,170,580 | B1 | 1/2001 | Reddoch | 175/66 |
| 6,179,070 | B1 | 1/2001 | Dietzen | 175/66 |
| 6,279,471 | B1 | 8/2001 | Reddoch | 100/37 |
| 6,315,813 | B1 | 11/2001 | Morgan et al. | 95/23 |
| 6,345,672 | B1 * | 2/2002 | Dietzen | 175/66 |
| 6,346,197 | B1 | 2/2002 | Stephenson et al. | 210/704 |
| 6,461,505 | B1 | 10/2002 | Danielsson et al. | 210/248 |
| 6,468,426 | B1 | 10/2002 | Klass | 210/304 |
| 6,491,167 | B2 | 12/2002 | Mahrenholtz et al. | 209/722 |
| 6,506,311 | B2 | 1/2003 | DeGarmo et al. | 210/788 |
| 6,533,946 | B2 | 3/2003 | Pullman | 210/787 |
| 6,582,600 | B1 | 6/2003 | Hashmi et al. | 210/512.2 |
| 6,585,115 | B1 | 7/2003 | Reddoch et al. | 209/3 |
| 6,596,169 | B1 | 7/2003 | Rong et al. | 210/512.1 |
| 6,602,181 | B2 | 8/2003 | Quintero et al. | 588/250 |
| 6,698,989 | B2 | 3/2004 | Snowdon | 414/137 |
| 6,702,539 | B2 | 3/2004 | Snowdon | 414/137.1 |
| 6,709,216 | B2 | 3/2004 | Snowdon | 414/137 |
| 6,709,217 | B1 | 3/2004 | Snowdon | 414/137.1 |
| 6,793,814 | B2 | 9/2004 | Fout et al. | 210/188 |
| 2001/0039887 | A1 | 11/2001 | Reddoch | 100/117 |
| 2002/0033278 | A1 | 3/2002 | Reddoch | 125/57 |
| 2002/0074269 | A1 | 6/2002 | Hensley et al. | |
| 2002/0100615 | A1 | 8/2002 | Curlett et al. | 175/65 |
| 2003/0006202 | A1 | 1/2003 | Boutte et al. | |
| 2004/0086345 | A1 | 5/2004 | Snowdon | 406/198 |
| 2004/0086360 | A1 | 5/2004 | Snowdon | 414/137.1 |
| 2004/0096298 | A1 | 5/2004 | Snowdon | 414/137.1 |

FOREIGN PATENT DOCUMENTS

| | | |
|---|---|---|
| EP | 0 705 214 B1 | 9/1997 |
| EP | 0 502 882 B1 | 5/2000 |
| GB | 1386710 | 7/1973 |
| GB | 1426035 | 1/1974 |
| GB | 1595065 | 1/1977 |
| GB | 2089403 A | 6/1982 |
| GB | 2147397 A | 9/1983 |
| GB | 2.238.730 A | 5/1990 |
| GB | 2.289.705 A | 5/1994 |
| GB | 2.301.382 A2 | 11/1995 |
| GB | 2.297.702 A | 3/1996 |
| GB | 2297702 A | 8/1996 |
| GB | 2297202 A | 11/1996 |
| GB | 2327442 A | 1/1999 |
| GB | 2327958 A | 2/1999 |
| GB | 2339443 A | 1/2000 |
| GB | 2344336 A | 6/2000 |
| WO | WO 95/00426 | 1/1995 |
| WO | WO 99/04134 | 1/1999 |
| WO | WO 99/06668 | 2/1999 |
| WO | WO 99/22113 | 5/1999 |
| WO | WO 00/76889 A1 | 12/2000 |
| WO | WO 01/00313 A1 | 1/2001 |
| WO | WO 01/20120 A1 | 3/2001 |
| WO | WO 01/42519 A1 | 5/2001 |
| WO | 2002/004044 | 9/2002 |

* cited by examiner

POSITIVE PRESSURE DRILLED CUTTINGS MOVEMENT SYSTEMS AND METHODS

BACKGROUND OF THE INVENTION

1. Field of the Invention

The present invention is directed to the positive pressure pneumatic transport of wet solids, and, in one particular aspect, to the movement of oilfield drilled cuttings or other heavy wet solids for disposal, storage or further processing.

2. Description of Related Art

The prior art discloses various methods for the positive pressure pneumatic continuous pneumatic transport of low slurry density and low particle density dry solids and non-continuous high slurry density transport of high particle density wet material. Many low density slurries typically have particles mixed with air with a specific gravity less than 1.0. The prior art discloses various methods that employ the vacuum transport of high particle and low particle density solids.

There has long been a need, recognized by the present inventors, for continuous positive pressure pneumatic transport of low slurry density, high particle density material, and in certain aspects, oilfield drilled cuttings or other oily/wet waste material.

SUMMARY OF THE PRESENT INVENTION

The present invention, in certain aspects, provides systems and methods for moving material that has a low slurry density, (e.g. with a specific gravity between 2.3 and 4.0 and, in one aspect, about 2.7 or lower) and a high particle density, (e.g. 2 lbs/gallon–4 lbs/gallon or higher) with a positive pressure pneumatic fluid, e.g. air or steam. In one particular aspect the material is a slurry that includes drilled cuttings from a wellbore, well drilling fluids, drilling muds, water, oil, and/or emulsions with the cuttings present as varying weight percents of the slurry. "Slurry density" refers to material from a well in an air flow and "particle density" refers to the material prior to its inclusion in an air flow.

In certain aspects systems and methods according to the present invention provide the continuous or almost-continuous transport of material.

In certain particular embodiments the present invention provides systems with storage facilities for solids to be moved and apparatus for mixing heavy solids to be transported with a pneumatic fluid, e.g., but not limited to, air or steam, at a positive pressure, i.e. above atmospheric pressure. In one aspect the velocity of moving solids is reduced using, e.g., a separator apparatus, and then the solids are collected in collection apparatus (e.g. tanks, boxes, storage containers). In certain aspects self-unloading tanks are used that have a positive pressure solids removal system. Such tanks may have systems for measuring the amount of solids in the tanks and providing an indication of this amount.

In one aspect the present invention provides apparatus for reduces the density of a slurry of material. Such apparatus includes decelerator/separator apparatus.

In particular embodiments in a method according to the present invention drilled cuttings are collected from a drilling rig (in one aspect, as they are produced) and then moved using positive pressure air and then flowed into a slurry expansion chamber apparatus which reduces the density of the incoming material. The slurry is then transported through conduit(s), e.g. at about 200 mph, 250 mph, or higher to separator apparatus that separates solids in the slurry from the air. The separated solids can be stored, shipped, or moved to other apparatus for further processing. In one such method about thirty-five tons per hour of solids are processed. In one aspect a slurry is, by volume, about fifty percent cuttings (plus wet fluid) and about fifty percent pneumatic fluid. In other aspects the cuttings (plus wet fluid) range between two percent to sixty percent of the slurry by volume.

It is, therefore, an object of at least certain preferred embodiments of the present invention to provide:

New, useful, unique, efficient, non-obvious systems and methods for transporting wet solids using positive pressure pneumatic fluid;

Such systems and methods in which the wet solids include drilled cuttings from a wellbore;

Such systems and methods which provide for the continuous or almost-continuous transport of low slurry density, high particle density material; and New, useful, unique, efficient and non-obvious apparatuses and devices useful in such systems and methods.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of certain embodiments of the invention may be had by references to the embodiments which are shown in the drawings which form a part of this specification.

DESCRIPTION OF EMBODIMENTS PREFERRED AT THE TIME OF FILING FOR THIS PATENT

Figure 1:
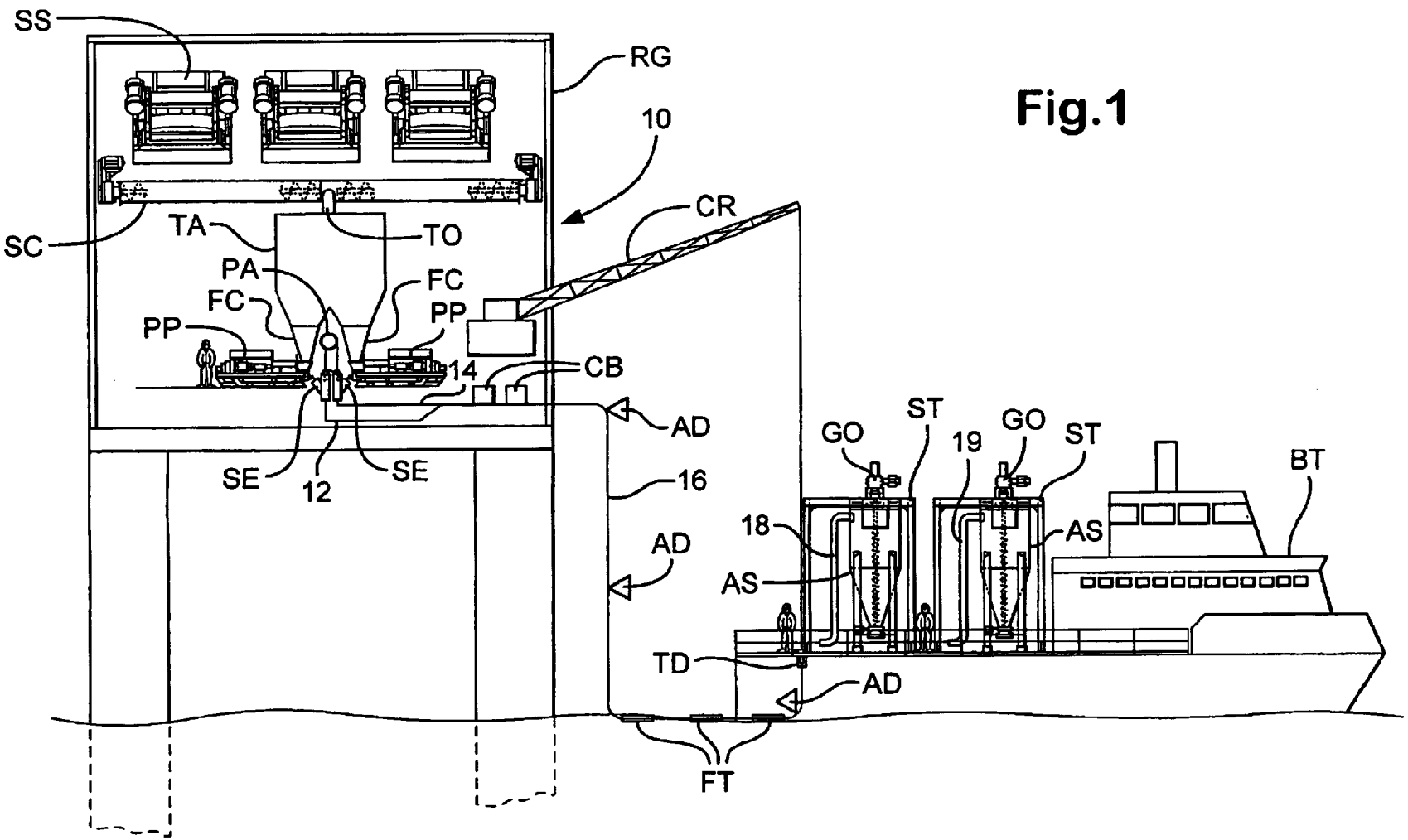
FIGS. 1–5 are schematic views of systems according to the present invention.

FIG. 1 shows a system 10 according to the present invention which has one or more (three shown) shale shakers SS mounted on an offshore rig RG. The shale shakers process drilling fluid having drilling solids, drilled cuttings, debris, etc. entrained therein. Separated solids and/or cuttings (with minimal liquid) exit the shale shakers S and are fed to a screen conveyor SC (or to any other suitable cuttings movement apparatus or device) which moves the separated solids to a feed opening TO of a tank TA.

Solids from the tank TA are pumped, optionally, by one or more pumps PP (two shown) in a line 16 and, optionally, to and through collection devices; e.g. optional cuttings boxes CB are shown in FIG. 1. Pressurized air from a pressurized air source flows to slurry expansion chambers SE in which the density of the solids pumped from the tank TA is reduced. In one particular embodiment air is provided at about 3000 cubic feet per minute to 6000 cubic feet per minute (or about 400 to 800 ACFM (actual cubic feet per minute at 100 p.s.i.) air pressure in a line 16 ranges between 15 and 40 p.s.i.; and, preferably, the solids density is relatively low, e.g. between 1 and 2 pounds per gallon of fluid flowing in the line 16. The solids are impelled from the slurry expansion chambers SE by the pressurized air into lines 12 and 14 that flow into the line 16. Desirably, one such system will process 20 to 40 tons of material per hour. Preferably solids, cuttings, etc. flow continuously in the line 16 to storage tanks on a boat BT.

Floats FT may be used with the line 16 and tether/disconnect apparatus TD provides selective and releasable connection of the line 16 to corresponding flow lines 18 and 19 of the storage tank systems ST. Optionally, air/solids separators AS may be used to remove air from the incoming fluid and/or to concentrate the solids therein. Air escapes from the systems ST via gas outlets GO and solids exiting the systems ST flow directly to a dock/shipping facility or are collected in containers on the boat BT. The line 16 and/or tether/disconnect apparatus TD may be supported by a crane CR on the rig RG. It is also within the scope of this invention for its systems and methods to be used on land.

In one particular aspect the systems ST employ self-unloading storage tanks which have one or more air inlets on their sides with pressurized air flow lines connected thereto to prevent wet solids build upon the tanks internal walls and interior surfaces and to facilitate solids movement from the tanks. Optional air assist devices AD through which air under pressure is introduced into the line 16 may be used on the line 16 to facilitate solids flow therethrough.

Figure 2:
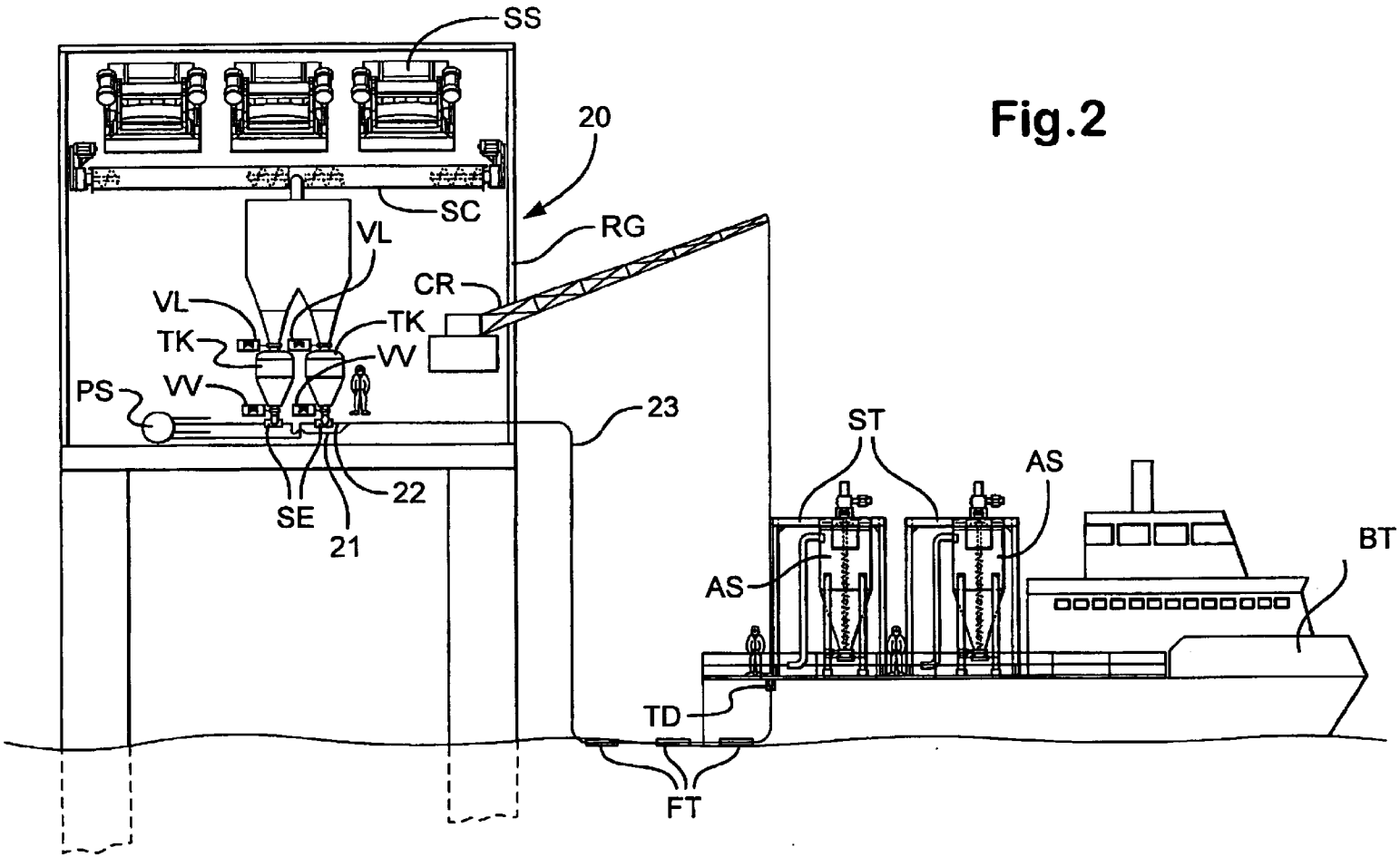

FIG. 2 shows a system 20 according to the present invention, like the system 10 (like numerals and letters indicate like parts), but with tanks TK receiving solids from the tank TA. The solids flow by gravity into the tanks TK. Alternatively, or in addition to gravity flow, the solids may be moved by suitable conveyor apparatus, screw conveyor (s), belt movement apparatus, etc. Valves VL selectively control flow into the tanks TK and valves VV selectively control flow from the tanks TK into flow lines 21, 22. Pressurized air from a pressurized air source PS forces the solids from lines 21, 22 into a line 23 (like the line 16, FIG. 1).

Figure 3:
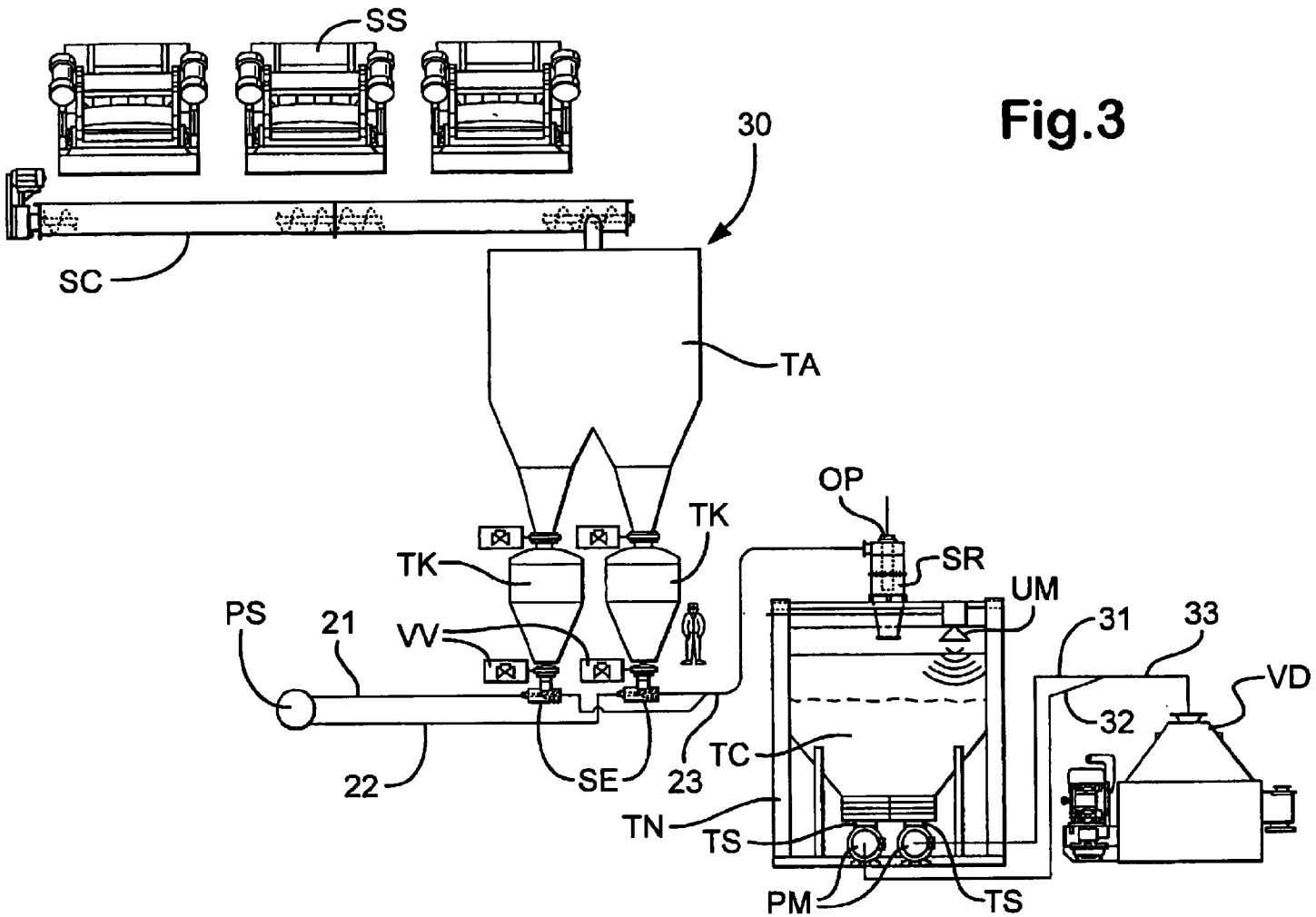

FIG. 3 shows a system 30 according to the present invention, in which some parts and apparatuses are like those of the systems 10 and 20 (like numerals and letters indicate like apparatuses and items). Material flows in the line 23 to a separator SR from which solids flow to a tank TC of a system TN. Gas (primarily if not wholly air) flows out from an opening OP of the separator SR. Pumps PM (one, two, or more) (e.g. cement pumps or progressive cavity pumps) pump solids from the tank TC in lines 31, 32 and 33 to a vortex dryer VD. In certain aspects only one of the pumps PM is operational at any given time. One, two or more tanks TC may be used. Separated solids exit from the bottom of the vortex dryer VD. In one particular aspect the cuttings coming out of the bottom of the vortex dryer are about 95% dry, i.e., 5% by weight of the solids exit stream is oil, drilling fluid, etc. In certain aspects the systems 20 and 30 achieve continuous flow of 20 to 40 tons of solids per hour. An ultrasonic meter UM indicates the depth of solids in the tank TC and tank sensors TS measure the weight of solids therein.

Figure 4:
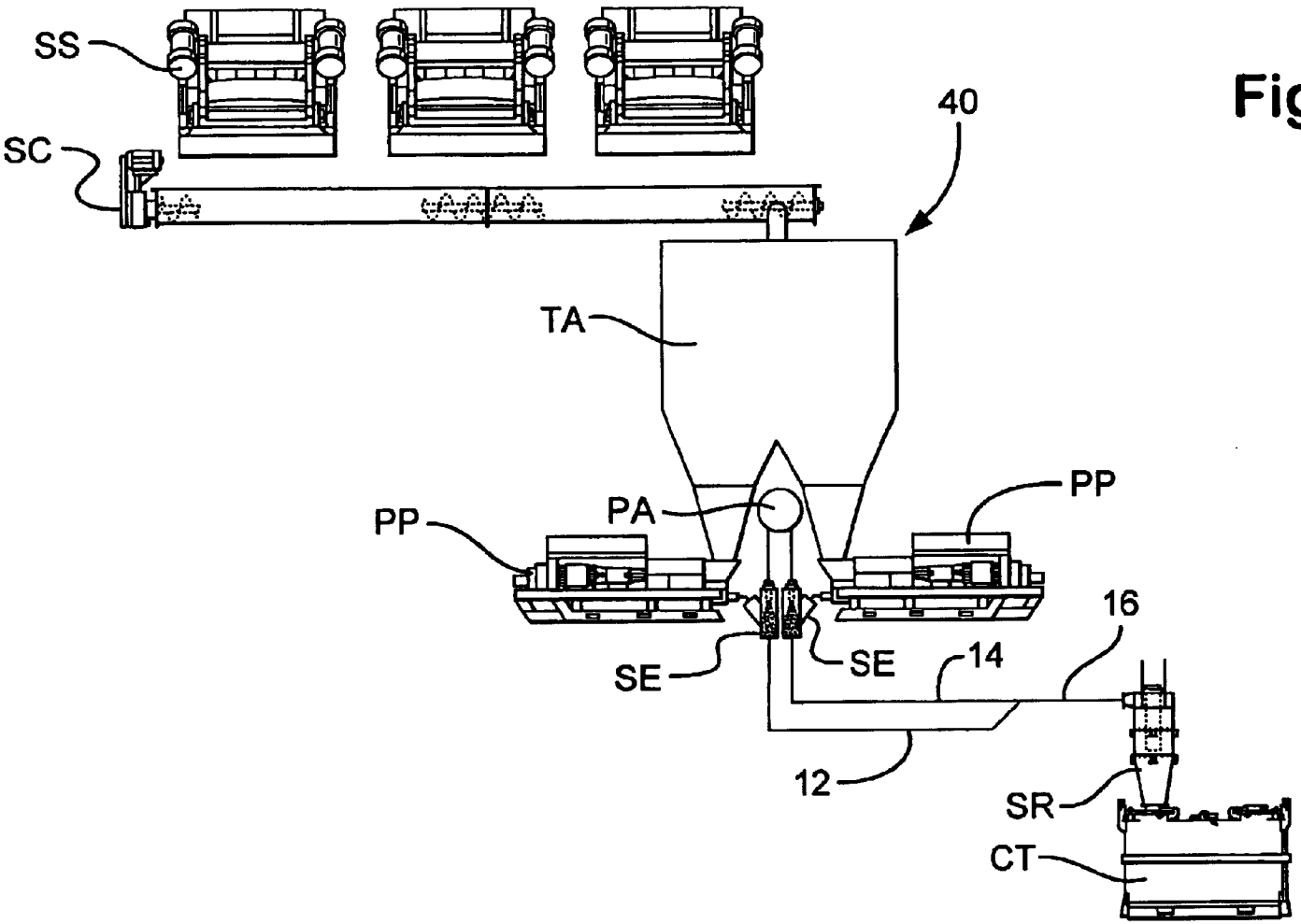

FIG. 4 shows a system 40 according to the present invention which has some apparatuses and items like the systems 10, 20 and 30 (and like numerals and letters indicate like apparatuses and items). The separator SR separates solids from air in the line and feeds them primarily via gravity (optionally with a pressurized air assist) to one or more cuttings boxes CT. Air may be vented from opening(s) in the box CT. According to the present invention a separator SR can be a separate apparatus interconnected with a tank or box in fluid communication therewith or it can be built into a tank or box as are integral part thereof. In one particular aspect the cuttings box CT is a commercially available Brandt FD-25 (Trademark) Cuttings Box.

Figure 5:
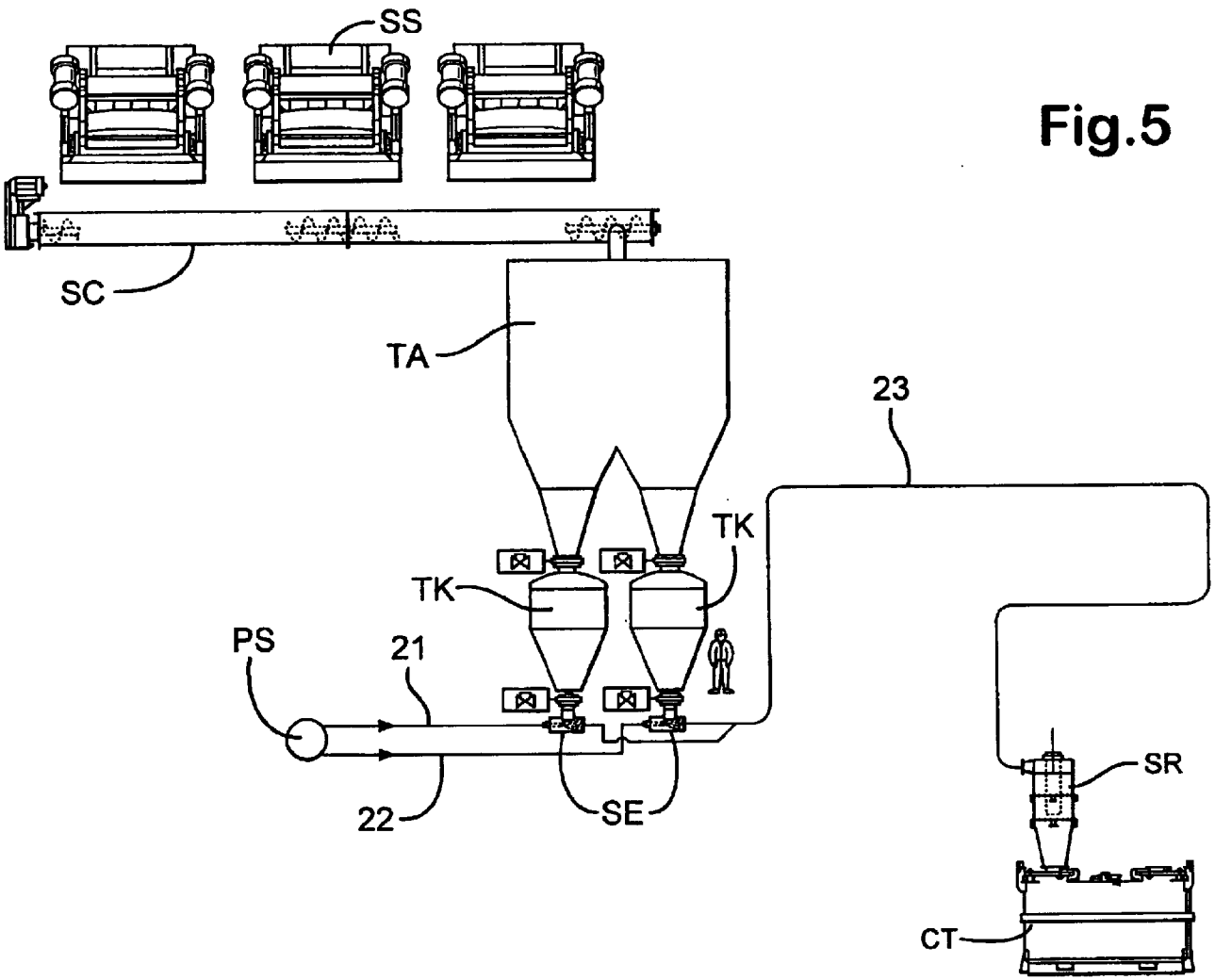
Figure 6A:
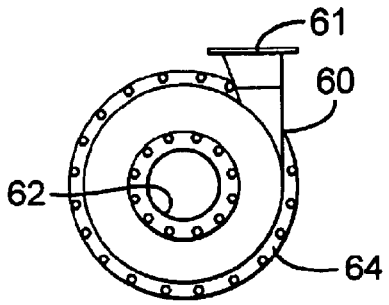
FIG. 6A is a top view of an air/solids separator according to the present invention.
Figure 6B:
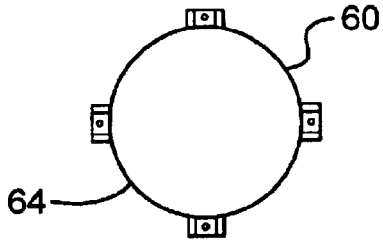
FIG. 6B is a cross-section view and FIG. 6C is a side view of the separator of FIG. 6A.
Figure 6C:
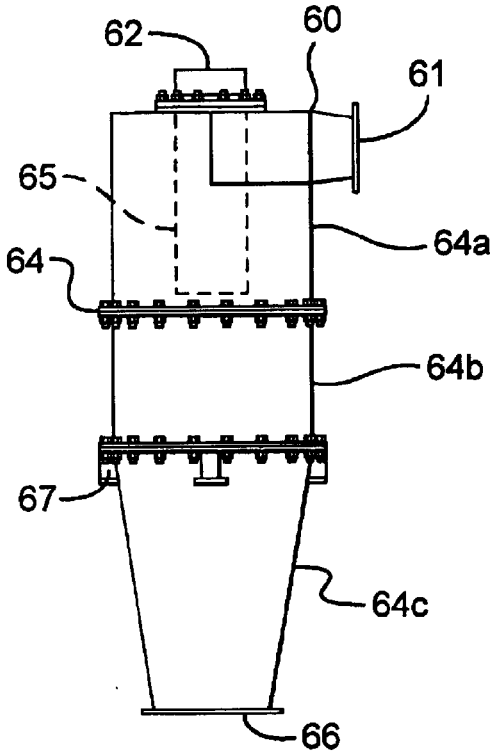
Figure 6D:
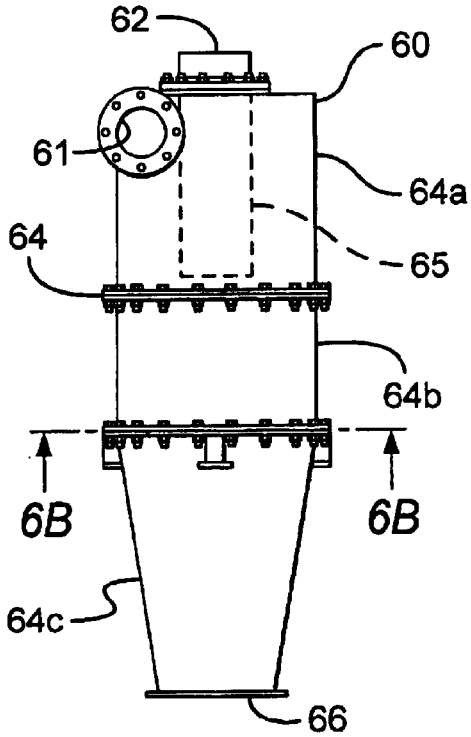
FIG. 6D is a front view of the separator of FIG. 6A.

FIG. 5 shows a system 50, like the system 20 (like numerals and letters indicate like apparatuses and items), but with material fed in the line 23 to a separator SR on a cuttings box CT.

FIGS. 6A–6D show one embodiment of a separator 60 according to the present invention which may be used as the separator SR, above. A top 64*a*, mid section 64*b*, and lower section 64*c* are bolted together to form a housing 64. Material is fed into the top section 64*a* through a feed inlet 61 that is, preferably, tangent to the diameter. Gas flows out through a top opening 62. Mounted within the housing 64 is a generally cylindircal hollow vortex finder 65. In one particular aspect the diameter of the vortex finder 65 and the diameter of a solids exit opening 66 of the lower section 64*c* are sized so that the flow from the opening 66 is primarily solids (e.g. between about 80% to 99% solids by weight) and the flow of gas out of the top opening 62 is primarily (99% or more) air; e.g. with a housing 64 that is about 48 inches in height, with a mid section 64*b* about 24 inches in diameter, the top opening 62 is about 12 inches in diameter and the bottom opening 66 is about 10 inches in diameter. It is within the scope of this invention to provide such an apparatus with dimensions of any desired size.

Mounts 67 facilitate mounting of the separator SR on a tank, rig, boat, or other structure. Any suitable support, e.g. one or more posts 68, may be used.

Figure 7:
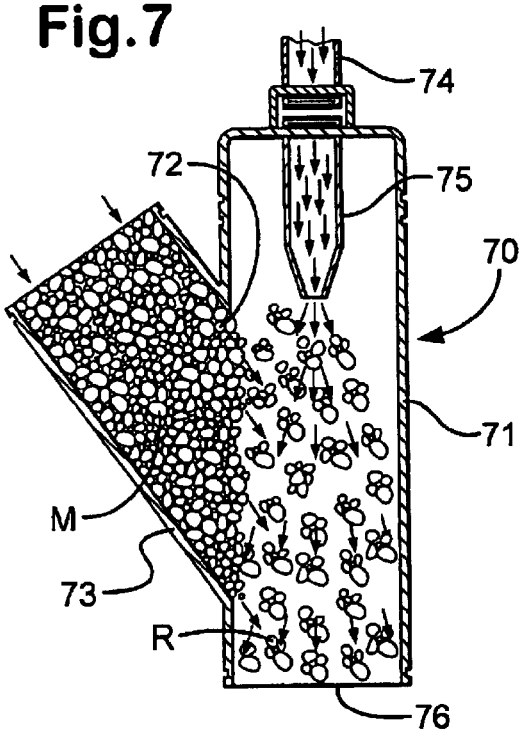
FIGS. 7 and 8 are side cross-section views of slurry expansion chamber apparatus according to the present invention.

FIG. 7 shows a slurry expansion chamber apparatus 70 according to the present invention which has a main hollow body 71 with an opening 72. Material M flows through a feed tube 73 (e.g. cuttings, fluid, and material from a wellbore) through the opening 72 into the main hollow body 71. Air under pressure from any suitable pressurized air source is introduced into a feed conduit 74 and then into a nozzle 75. The air mixes with the material M, reduces its density, and propels the reduced-density material R out through an exit opening 76. Optionally the nozzle 75 is deleted and the air flow and/or movement into the expansion chamber reduces the density of the material.

Figure 8:
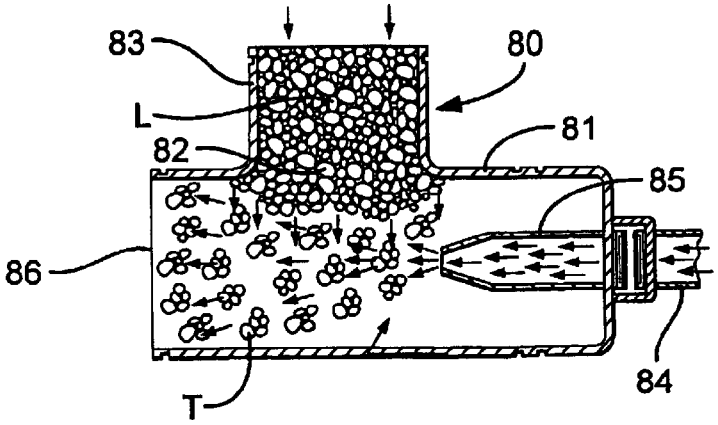

FIG. 8 shows a slurry expansion chamber apparatus 80 according to the present invention which has a main hollow body 81 with an opening 82. Material L flows through a feed tube 83 (e.g. cuttings, fluid and material from a wellbore) through the opening 82 into the body 81. Air under pressure from a pressurized air source is introduced into a feed conduit 84 and then into a nozzle 85. The air mixes with the material L, reduces its density, and propels the reduced-density material T out through an exit opening 86. The apparatus in FIGS. 7 and 8 may be used as the slurry expansion chamber apparatuses in the systems of FIGS. 1–5.

Figure 9:
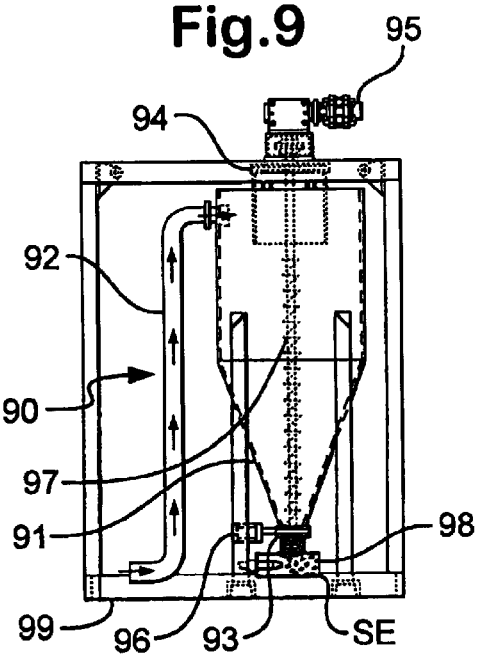
FIG. 9 is a side schematic view of a separator according to the present invention.

FIG. 9 shows an air/solids separator 90 usable as the separators AS, FIG. 1, mounted on a base 99. A mixture of air and solids is introduced into a tank 91 through a feed conduit 92. Solids flow by gravity to an exit opening 93.

Optionally, a slurry expansion chamber apparatus SE receives the solids and propels them through a pipe 98 to storage, to a collection tank or tanks, or to a cuttings box, on shore, on a rig, or on a boat or barge. Air flows out from a top opening 94.

Optionally the separator 90 may be provided witha motor apparatus 95 (e.g., a gear-box/air-motor-apparatus device) that rotates a screw 97 that inhibits or prevents the bridging of solids within the tank 91. Alternatively or in addition to such motor apparatus, devices like the air assist devices AD described above may be used to inhibit such bridging.

A valve 96 (e.g., an air-operated valve) selectively closes off the opening 93 as desired.

The present invention, therefore, in at least certain embodiments, provides a method for moving drilled cuttings material, the method including conveying with fluid under positive pressure drilled cuttings material to flow conduit apparatus, applying fluid (e.g., air or steam) under positive pressure to the flow conduit apparatus to continuously move the drilled cuttings material therethrough, continuously moving the drilled cuttings material with the fluid under pressure to separation apparatus, and with the separation apparatus continuously separating drilled cuttings from the fluid.

Such a method may also include one or some (in any possible combination) of the following: wherein the drilled cuttings are included in a low density slurry with drilling fluid; wherein the separation apparatus is a cyclone separator and the drilled cuttings moved into the cyclone separator are wet; wherein a flow pipe interconnects the separation apparatus in fluid communication with drying apparatus, the method further including flowing wet drilled cuttings through the flow pipe to the drying apparatus, and drying the wet drilled cuttings with the drying apparatus; flowing the drilled cuttings material to expansion chamber apparatus, and reducing density of the drilled cuttings material in the expansion chamber apparatus; wherein the density of the drilled cuttings material is reduced by flowing air into the material within the expansion chamber apparatus; wherein the air flows into and out through a nozzle within the expansion chamber apparatus; wherein the drilled cuttings flow in a main conduit to the separation apparatus, the main conduit having at least one air movement assistance device, the method further including facilitating movement of the drilled cuttings material through the main conduit with air from the at least one air movement assistance device; moving separated drilled cuttings from the separation apparatus to collection apparatus, the collection apparatus from the group consisting of cuttings box or boxes, tank or tanks, storage device, container or containers, and receptacle(s) on a boat or barge; wherein prior to conveying drilled cuttings material to the flow conduit apparatus the material is fed into tank apparatus, the method further inlcuding pumping the material from the tank apparatus into the flow conduit apparatus; wherein the pumping includes pumping the material from the tank apparatus into expansion chamber apparatus and therethrough into the flow conduit apparatus; wherein the tank apparatus includes valve apparatus for selectively controlling flow of the material into the flow conduit apparatus; wherein at least a portion of the flow conduit apparatus is in water and float apparatus is on the flow conduit apparatus, the method further including facilitating floating of at least a portion of the flow conduit apparatus in the water with the float apparatus; wherein the drying apparatus is a vortex dryer; wherein the drilled cuttings material is included within a slurry of material, wherein the slurry has a low slurry density, and wherein upon mixing of the slurry with the fluid under positive pressure a resultant slurry is produced, the resultant slurry having a high particle density; and/or wherein the slurry has a specific gravity between 2.3 and 4.0 and the particle density of the resultant slurry is between 2 pounds/gallon and 4 pounds/gallon.

The present invention, therefore, in at least certain embodiments, provides a method for moving drilled cuttings material, the method including conveying with fluid (e.g., air) under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, with the separation apparatus continuously separating drilled cuttings from the air, wherein the separation apparatus is a cyclone separator and the drilled cuttings moved into the cyclone separator are wet, wherein a flow pipe interconnects the separation apparatus in fluid communication with drying apparatus, flowing wet drilled cuttings through the flow pipe to the drying apparatus, drying said wet drilled cuttings with the drying apparatus, flowing the drilled cuttings material to expansion chamber apparatus, and reducing density of the drilled cuttings material in the expansion chamber apparatus, wherein the density of the drilled cuttings material is reduced by flowing air into said material within the expansion chamber apparatus, moving separated drilled cuttings from the separation apparatus to collection apparatus from the group consisting of cuttings box, tank, storage device, container, and receptacle on a boat, wherein the drilled cuttings material is included within a slurry of material, wherein the slurry has a low slurry density, and wherein upon mixing of the slurry with the fluid under positive pressure a resultant slurry is produced, the resultant slurry having a high particle density, and wherein the slurry has a specific gravity between 2.3 and 4.0 and the particle density of the resultant slurry is between 2 pounds/gallon and 4 pounds/gallon.

The present invention, therefore, in at least certain embodiments, provides a system for moving drilled cuttings, the system having movement apparatus for moving drilled cuttings, tank apparatus into which the movement apparatus can move the drilled cuttings, flow conduit apparatus for receiving the drilled cuttings from the tank apparatus, pressurized fluid apparatus for applying air under positive pressure to the drilled cuttings and for continuously moving the drilled cuttings through the flow conduit apparatus and to separation apparatus, and separation apparatus for continuously receiving the drilled cuttings through the flow conduit apparatus, the separation apparatus for separating the drilled cuttings from air; and such a ssytem wherein the drilled cuttings are wet and the system further has drying apparatus for drying the drilled cuttings.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of their invention and of the claims that follow as they may pertain to apparatus not materially departing from, but outside of, the literal scope of the invention as set forth in the following claims. Any patent or patent application referred to herein is incorporated fully herein for all purposes.

What is claimed is:

1. A method for moving drilled cuttings material, the method comprising conveying with fluid under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, with the separation apparatus continuously separating drilled cuttings from the air, wherein the separation apparatus is a cyclone separator and the drilled cuttings moved into the cyclone separator are wet, wherein a flow pipe interconnects the separation apparatus in fluid communication with drying apparatus, flowing wet drilled cuttings through the flow pipe to the drying apparatus, drying said wet drilled cuttings with the drying apparatus, flowing the drilled cuttings material to expansion chamber apparatus, reducing density of the drilled cuttings material in the expansion chamber apparatus, wherein the density of the drilled cuttings material is reduced by flowing air into said material within the expansion chamber apparatus, moving separated drilled cuttings from the separation apparatus to collection apparatus from the group consisting of cuttings box, tank, storage device, container, and receptacle on a boat, wherein the drilled cuttings material is included within a slurry of material, and wherein upon mixing of the slurry with the fluid under positive pressure a resultant slurry is produced, and wherein the slurry has a specific gravity between 2.3 and 4.0 and the particle density of the resultant slurry is between 2 pounds/gallon and 4 pounds/gallon.

2. A method for moving drilled cuttings material, the method comprising conveying with fluid under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, with the separation apparatus continuously separating drilled cuttings from the air, and moving separated drilled cuttings from the separation apparatus to collection apparatus from the group consisting of cuttings box, tank, storage device, container, and receptacle on a boat.

3. The method of claim 2 wherein the drilled cuttings are included in a low density slurry with drilling fluid.

4. The method of claim 2 wherein the separation apparatus is a cyclone separator and the drilled cuttings moved into the cyclone separator are wet.

5. The method of claim 4 wherein a flow pipe interconnects the separation apparatus in fluid communication with drying apparatus, the method further comprising flowing wet drilled cuttings through the flow pipe to the drying apparatus, and drying said wet drilled cuttings with the drying apparatus.

6. The method of claim 2 further comprising flowing the drilled cuttings material to expansion chamber apparatus, and reducing density of the drilled cuttings material in the expansion chamber apparatus.

7. The method of claim 6 wherein the density of the drilled cuttings material is reduced by flowing air into said material within the expansion chamber apparatus.

8. The method of claim 7 wherein the air flows into and out through a nozzle within the expansion chamber apparatus.

9. The method of claim 2 wherein the drilled cuttings flow in a main conduit to the separation apparatus, the main conduit having at least one air movement assistance device, the method further comprising facilitating movement of the drilled cuttings material through the main conduit with air from the at least one air movement assistance device.

10. The method of claim 2 wherein prior to conveying drilled cuttings material to the flow conduit apparatus said material is fed into tank apparatus, the method further comprising pumping said material from the tank apparatus into the flow conduit apparatus.

11. The method of claim 10 wherein said pumping includes pumping said material from the tank apparatus into expansion chamber apparatus and therethrough into the flow conduit apparatus.

12. The method of claim 10 wherein the tank apparatus includes valve apparatus for selectively controlling flow of said material into the flow conduit apparatus.

13. The method of claim 2 wherein at least a portion of the flow conduit apparatus is in water and float apparatus is on the flow conduit apparatus, the method further comprising facilitating floating of at least a portion of the flow conduit apparatus in the water with the float apparatus.

14. The method of claim 5 wherein the drying apparatus is a vortex dryer.

15. The method of claim 2 wherein the drilled cuttings material is included within a slurry of material, wherein the slurry has a low slurry density, and wherein upon mixing of the slurry with the fluid under positive pressure a resultant slurry is produced, the resultant slurry having a high particle density.

16. The method of claim 15 wherein the slurry has a specific gravity between 2.3 and 4.0 and the particle density of the resultant slurry is between 2 pounds/gallon and 4 pounds/gallon.

17. A system for moving drilled cuttings, the system comprising movement apparatus for moving drilled cuttings, tank apparatus into which the movement apparatus can move the drilled cuttings, flow conduit apparatus for receiving the drilled cuttings from the tank apparatus, pressurized fluid apparatus for applying air under positive pressure to the drilled cuttings and for continuously moving the drilled cuttings through the flow conduit apparatus and to separation apparatus, and separation apparatus for continuously receiving the drilled cuttings through the flow conduit apparatus, the separation apparatus for separating the drilled cuttings from air, and collection apparatus for receiving separated drilled cuttings from the separation apparatus, the collection apparatus from the group consisting of cuttings box, tank, storage device container, and receptacle on a boat.

18. The system of claim 17 wherein the drilled cuttings are wet and the system further comprising drying apparatus for drying the drilled cuttings.

19. A method for moving drilled cuttings material, the method comprising conveying with fluid under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, the separation apparatus being a cyclone separator and the drilled cuttings moved into the cyclone separator are wet, and with the separation apparatus continuously separating drilled cuttings from the air.

20. A method for moving drilled cuttings material, the method comprising conveying with fluid under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, with the separation apparatus continuously separating drilled cuttings from the air, flowing the drilled cuttings material to expansion chamber apparatus, and reducing density of the drilled cuttings material in the expansion chamber apparatus.

21. A method for moving drilled cuttings material, the method comprising flowing drilled cuttings material into tank apparatus, pumping said drilled cuttings material from the tank apparatus into an expansion chamber apparatus conveying with fluid under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, and with the separation apparatus continuously separating drilled cuttings from the air.

22. A method for moving drilled cuttings material, the method comprising conveying with fluid under positive pressure drilled cuttings material to flow conduit apparatus, applying air under positive pressure to the flow conduit apparatus to continuously move the drilled cuttings material therethrough, continuously moving the drilled cuttings material with the air under pressure to separation apparatus, with the separation apparatus continuously separating drilled cuttings from the air, wherein at least a portion of the flow conduit apparatus is in water and float apparatus is on the flow conduit apparatus, the method further comprising facilitating floating of at least a portion of the flow conduit apparatus in the water with the float apparatus.

* * * * *